United States Patent [19]

Littleton

[11] Patent Number: 4,919,027

[45] Date of Patent: Apr. 24, 1990

[54] SHEET DIVERTING AND DELIVERY SYSTEM

[75] Inventor: Francis J. Littleton, Alden, N.Y.

[73] Assignee: Littleton Industrial Consultants, Inc., Alden, N.Y.

[21] Appl. No.: 123,548

[22] Filed: Nov. 20, 1987

[51] Int. Cl.[5] ..... B41F 13/60; B65H 29/60; B65H 29/68

[52] U.S. Cl. ..... 83/107; 83/102; 83/110; 83/112; 83/346; 271/182; 271/302; 271/303

[58] Field of Search ..... 83/103, 105, 106, 110, 83/112, 113, 674, 107, 102, 346; 198/441; 271/297, 303, 270, 202, 258, 182, 198

[56] References Cited

U.S. PATENT DOCUMENTS

| | | | |
|---|---|---|---|
| 2,164,436 | 7/1939 | Waters | 93/56.2 |
| 2,852,256 | 9/1958 | Faulls, Jr. et al. | 271/76 |
| 3,218,897 | 11/1965 | Geigenmiller et al. | 83/88 |
| 3,391,777 | 7/1968 | Joa | 198/35 |
| 3,507,489 | 4/1970 | Wilshin et al. | 271/46 |
| 3,565,423 | 2/1971 | Kluth | 271/76 |
| 3,994,221 | 11/1976 | Littleton | 271/202 |
| 3,999,454 | 12/1976 | Tiso et al. | 83/107 |
| 4,040,617 | 8/1977 | Walkington | 271/177 |
| 4,214,744 | 7/1980 | Evans | 271/202 |
| 4,364,552 | 12/1982 | Besemann | 271/182 |
| 4,373,713 | 2/1983 | Loebach | 271/303 |
| 4,426,897 | 1/1987 | Littleton | 83/37 |
| 4,516,759 | 5/1985 | Kobler | 270/12 |
| 4,682,767 | 7/1987 | Littleton | 270/45 |

FOREIGN PATENT DOCUMENTS

| | | |
|---|---|---|
| 0089407 | 11/1982 | European Pat. Off. . |
| 2141340 | 2/1973 | Fed. Rep. of Germany . |
| 408060 | 9/1966 | Switzerland . |
| 1158844 | 7/1969 | United Kingdom . |
| 1208969 | 10/1970 | United Kingdom . |
| 1541562 | 3/1979 | United Kingdom . |

*Primary Examiner*—Hien H. Phan

*Attorney, Agent, or Firm*—Neuman, Williams, Anderson & Olson

[57] ABSTRACT

An apparatus for diverting and delivering sheets in which the sheets are positively controlled throughout the entire operation. Initially, a continuous web of paper passes between opposing cylinders comprising a rotary cutter. The lead edge of the web is then engaged by a pair of opposed nip rollers. Once held by these nip rollers, the rotary knife cuts a separate sheet from the front of the continuous web. The separate sheet then passes between and is accelerated by the nip rollers whereupon a dual set of diverting cams, in combination with a pair of conveyors, directs the sheet to one of two delivery systems. The next subsequent sheet is directed to the other delivery system so that each successive sheet is alternately diverted between the two delivery systems. Upon exiting either delivery system, the sheet is subjected to a snubbing means which decelerates the sheet and further allows the next subsequent sheet to overlap the previous sheet before being similarly decelerated. The shingled sheets are then transmitted by conveyor to a subsequent processing operation.

13 Claims, 4 Drawing Sheets

SHEET DIVERTING AND DELIVERY SYSTEM

BACKGROUND OF THE INVENTION

This is a continuation-in-part of application Ser. No. 849,083, filed Apr. 4, 1986 and now abandoned.

Field of Invention

In the printing industry, and particularly in a printing process, a continuous web of paper is first passed through the printing press which makes the ink impressions on the web. The moving web is then immediately passed through an oven to remove solvents and wetting solution retained from the printing process. The web is then cooled down by passing it over chill rollers. At this point the web is then ready to be folded and cut into its final format.

The present invention relates to an improved system for cutting a continuous paper web into separate sheets or signatures, alternately diverting or separating the individual sheets into two paths to create a space or gap between successive sheets and then decelerating and shingling or overlapping the successive sheets for delivery of the sheets to a subsequent process such as a sheet counter or stacker system as described in my U.S. Pat. No. 4,652,197. The present invention operates equally well with signatures which are one sheet thick or with signatures which are several sheets thick such as pamphlets, magazines or newspapers.

It is desirable to provide a diverter and delivery system in which sheets cut from the continuous web are alternately diverted into separate delivery paths by an improved diverter means. Additionally, it is desirable to provide an improved diverter and delivery system which maintains continuous, positive control over the sheets while the sheets are first cut and alternately diverted and then shingled in preparation for delivery to a subsequent processing station. Moreover, it is desirable to provide an improved delivery system which operates at a dramatically increased speed with respect to present delivery systems. The cutting operation, described in connection with the preferred embodiment of the present invention, is fully set forth in and described in my U.S. Pat. No. 4,426,897.

Previous diverting systems employ various methods and devices for directing sheets. The prior art discloses fixed or static diverters; cutting cylinders which additionally function as diverters; and rotating cam diverters.

Fixed or static diverters are disposed across the paper path and these diverters operate by having the sheets physically strike the diverter. The momentum of the moving sheets and the shape of the diverter surface combine to channel the sheets to the appropriate delivery conveyor. Such fixed diverter systems create the possibility of a lead edge foul condition as the lead edge of each sheet hits the diverter; generate static in the sheets as the sheets move across the stationary surface of the diverter; and are not variable in width to adapt to paper of differing widths. Each of these problems can ultimately jam the system thereby losing valuable time while the jam is cleared, wasting large amounts of paper in getting the system back up to running speed, and potentially damaging the machine itself. Lead edge foul is even more probable with a signature of more than one sheet when the leading edge is open. Due to the speed of travel of the signature, the leading edges of the group of sheets may separate thereby resenting a ripe target for causing a jam with the forward edge of the fixed diverter.

The problems associated with static diverters multiply when single sheets or signatures comprised of a few lightweight sheets are involved rather than a folded signature. Single or thin bundles of sheets, when unfolded, have less structural rigidity and are more apt to buckle when striking the fixed diverter. With folded signatures, a rigid spine is created by the fold which aids in maintaining structural integrity of the sheets as they strike and slide across the diverter. Moreover, the static generated from sheets sliding across the surface of the diverter is more likely to stop or misalign a single sheet of paper, because of its lighter weight, than a bundle of sheets.

In other prior art systems the cutting operation can perform the dual function of cutting the web of paper and then alternately diverting the individual sheets. In such systems, the web is passed between two, opposed knife cylinders, each of which includes a knife edge that is 180° out of phase with the knife edge of the other cylinder. These knife cylinders further include a row of cam operated pins which pierce and grip the web and then deliver the cut sheet to an associated delivery cylinder. Each delivery cylinder includes a cam operated gripper that grabs the leading edge of the cut sheet as the pins in the knife cylinder are withdrawn and deposits the cut sheets in a shingled fashion on a delivery conveyor system. As each successive sheet is layed down in a shingled format on the respective delivery conveyors, the gripper of the delivery cylinder releases the sheet. However, operations such as these create a great deal of wasted paper because the sheet edges must be subsequently cut in order to remove the pin holes. Moreover, the need to cut the edges adds a further processing step to the overall system which increases the time to produce a finished product and increases the costs.

Still further prior art systems disclose rotary cam diverters for alternately diverting successive sheets between two delivery systems. An example is shown in the British Patent No. 1,208,969. However, the system disclosed therein, because of its construction, creates potential jamming problems. Specifically, as the lower cams divert a sheet to the upper delivery system, the placement of the cams combined with the physical contour of the cams cause the cams to lose contact with the leading edge of the sheet prior to the sheet becoming trapped between the opposed belts of the upper delivery system. This lack of support can cause the leading edge of the sheet to drop and miss the entry into the delivery system. As a result, the sheet would foul and jam the system. Additionally, the static associated with the overlying belt against which the cams trap the sheet would actually repel a single or lightweight sheet prior to the leading edge being engaged by the upper and lower opposed belts of the delivery system. Consequently, the same fouling or jamming would occur.

In an attempt to remedy these problems, the prior art further shows the addition of guide members or steeples, as are shown in U.S. Pat. 4,373,713, which act in combination with the cams to provide continued support for the sheets while they are diverted to the delivery conveyors. While solving the support problem these guide plates create still greater static problems. As with a fixed diverter, the sheets are required to slide across the guide member which action creates static electricity. The generated static is sufficient to impede and misalign, if not jam, single or lightweight sheets. Consequently, the system disclosed is not only limited in the number, type and weight of sheets it can run but, more importantly, the system creates additional problems which it does not solve.

Various delivery systems, for shingling sheets are also set forth in the prior art. With delivery systems generally, it has always been a goal to increase the overall operating speed of the system. While printing presses operate at high speeds, it has always been necessary to drastically reduce the speed of the sheets in the delivery system both to shingle and to square the sheets. Squaring the sheets may be achieved by allowing the lead edge of each sheet to strike a fixed object such as a squaring roller. However, to avoid permanent damage to the sheets, particularly single or lightweight sheets, the paper should not be travelling faster than about 300 feet per minute. This limitation is a physical characteristic of most normal weight paper and, consequently, limits the overall output of the printing system by necessitating a reduced operating speed for the delivery system.

One delivery means known in the art is described above in connection with the rotary knife cylinders and cam operated pin grippers. This system employs a pair of delivery cylinders which grip alternate sheets and deposit them in overlapping relation on separate delivery conveyors. However, the need to cut off the edges of the sheets to remove the pin holes creates an additional handling step which makes this system slow and inefficient.

Another prior art delivery system employs a fan like element to shingle the sheets. By means of gravity, sheets are caused to fall into a receptive slot in a rotating fan-like delivery means. As the delivery means rotates the sheets fall out one after the other in an overlying or shingled arrangement. However, once a sheet has entered the fan delivery, the timing of the entire delivery system is subject to the gravitational forces working on the sheet. As a result, lightweight sheets could severely slow down a system otherwise capable of operating at higher speeds. The delivery system of the present invention improves upon this arrangement by maintaining continuous and positive control of each and every sheet, which this prior art system cannot do, and by increasing the operating speed with respect to this prior art system.

Other prior art delivery systems employ rotary knock down arms for decelerating the sheets but still require squaring rollers for aligning the sheets. While the knock down arms, by acting on the tail of the sheets, are an improvement over the use of fixed stops in decelerating the sheets, critical speed limitations are still present because of the squaring roller. Moreover, the knock down arm merely strikes the rapidly moving sheet throwing the sheet against a lower, slow speed belt. Because the sheet is unrestrained at this time the chance of it becoming misaligned or out of square is great.

An improvement over that system is disclosed in my U.S. Pat. No. 3,994,221. While still using a squaring roller, the deceleration procedure is improved by the use of a series of freely rotating snubber wheels mounted on rotating snubber support plates. Instead of only knocking the sheet down, allowing it to bounce onto the lower, slow speed belt, the snubber wheels actually physically trap the tails of the sheets against the slow speed belt while the lead edges of the sheets engage the squaring roller. This causes the sheets to decelerate more quickly but can still allow a misalignment. Consequently a squaring roller is still needed and still places a speed limitation on the system.

The present invention overcomes all of the aforementioned problems by maintaining a positive control over the sheets exiting the opposed, high-speed belts, during the decelerating process of the snubbers and during subsequent delivery. Specifically, the snubber wheels trap the individual sheets against the lower, slow speed belts while the tail of the sheets are still engaged by the opposed high-speed belts or immediately after the sheet has left the high-speed belts. While this may create a slight overfeed of the tail end of the sheets, it is not significant enough to permanently crease the sheets. By maintaining this positive control, the sheets are never allowed to become unaligned. Thus, the continual positive control allows the removal of the squaring roller which, in turn, allows the system to operate at a faster speed.

OBJECTS OF THE INVENTION

It is a general object of this invention to provide an improved sheet cutting, diverting and delivery system for use in connection with printing processes which positively controls each sheet throughout the entire process.

It is a further object of this invention to provide an improved diverter for separating a continuous stream of sheets into two paths.

It is another object of this invention to provide an improved means for delivering the sheets in a shingled or overlapped format.

It is still another object of the invention to provide an improved delivery system which does not require squaring rollers or similar fixed squaring means.

SUMMARY OF THE INVENTION

In accordance with one embodiment, a continuous web of paper is caused to travel by a first conveyor at a constant, high speed. The web is engaged by a pair of opposed nip rollers which maintain the alignment of the web. The web then passes between a rotary knife cylinder, with four blades, and an opposed anvil cylinder which cuts four equal length sheets or signatures from the web for every revolution of the knife cylinder. Preferably, before each successive sheet is cut from the web, the leading edge of the web, defined by the stroke of the previous blade, engages a pair of opposed nip rollers arranged downstream of the cutter. These nip rollers rotate at an angular velocity which is approximately eight percent faster than the speed of the web. Consequently, the nip rollers ensure that the leading edge of the next successive sheet to be cut from the web is held positively and securely in place and the acceleration experienced by the lead edge of the web insures that the web is under tension while the next sheet is cut away from the web. These features prevent jamming of the system which occurs in present systems where the sheets are unrestrained, allowing them to become easily unaligned.

In order to then shingle the sheets for delivery to a subsequent operation, such as counting and stacking, it is necessary to create a gap or space between the successive sheets. At this point the trailing edge of each sheet cut from the web is followed directly by the leading edge of the next sheet. While a space is created between sheets due to the eight percent increase in speed of the nip rollers, this space is insufficient to allow proper shingling of the sheets. One way to cause the formation of a sufficient gap is to alternately divert each successive sheet between two separate delivery systems. This will create a space between successive sheets at least equal to the length of an individual sheet and will be sufficient to allow the delivery portion of the present invention to decelerate and shingle the sheets as desired.

In addition to positively securing the sheets during cutting, the pair of nip rollers following the cutting cylinder define the entrance to the two delivery systems. The upper nip roller is part of a second conveyor system which comprises an upper delivery section. The lower nip roller is part of a third conveyor system which comprises a lower delivery section. Of course, the two delivery systems will function just as well in any relative orientation. As the successive sheets pass through the forward nip rollers they then encounter the sheet diverter of the present invention. The sheet diverter, as the name implies, diverts the sheets from their original path into either the upper delivery section or the lower delivery section. The sheet diverter includes two sets of multiple diverting cams which rotate in opposite directions about a pair of cam shafts. In operation, each set of rotating diverter cams are synchronized to alternately engage the successive sheets being fed from the cutting cylinder and divert the sheets to either the upper delivery section or the lower delivery section.

More specifically, the lower set of rotary cams engage a sheet and, through their rotation, divert the sheet upwardly where the top surface of the sheet engages a series of upper, high speed conveyor belts. These high speed conveyor belts are part of the upper delivery section and traverse the upper nip roller. As the sheet continues into the upper delivery section, the surface of the diverter cam remains in underlying contact with the sheet, guiding the sheet between the surface of the cam and the upper high-speed belts until the lead edge of the sheet passes over an idler roller comprising the beginning of an underlying high-speed conveyor. At this point, the leading edge of the sheet is now trapped between the upper high-speed belts and the underlying high-speed belts and the cams are still positively guiding the remainder of the sheet against the upper belts. The opposed hiqh-speed belts transport the sheet to the shingling section of the upper delivery section.

It is an important feature of the present invention that the cams engage and support the entire sheet, including most importantly, the leading edge, up until the leading edge is engaged by the opposed high-speed belts of the delivery section. This guarantees positive control of the sheets during the entire diverting process and prevents the problems associated with the prior art devices. Particularly, the generation of static is prevented because the sheets do not have to slide over any fixed or stationary objects. Instead, the cams rotate at approximately the same speed as the overlying high speed conveyor belts. As the cams continue their rotation, the tail of the sheet is disengaged from the cams and the entire sheet is now disposed between the opposed high-speed belts. The cams then complete their revolution and engage another sheet.

The diverting of sheets to the lower delivery section operates in much the same manner. Due to the synchronized movement of the rotary cams, after the lower diverter cams have completed diverting a sheet into the upper delivery section, the upper diverter cams re in position to divert the next subsequent sheet into the lower delivery section. In this instance, however, the surface of the upper cams divert the sheet downwardly and trap the lower surface of the sheet against a series of high-speed belts comprising part of the lower delivery section. During completion of the revolution of the upper diverter cams the sheet passes beneath a series of overlying high-speed belts which, in conjunction with the underlying high-speed belts, trap the sheet and transport it to the shingling portion of the lower delivery system. As with diverting sheets to the upper delivery section, the sheets are subject to continuous positive control.

As is readily apparent, the synchronized rotating cams operate to alternately divert sheets cut from the web without the use of cam controlled pins or grippers. Furthermore, the rotating cams are an improvement over prior art fixed diverters which lie in the path of the incoming sheets. Fixed diverters, such as these, are pointed toward incoming sheets, and cause fouling or jamming of the system when the leading edge of an incoming sheet hits the leading edge of the fixed diverter. Additionally, the static build up associated with sheets passing over stationary surfaces is avoided by the present invention. The diverter cams rotate at an angular velocity corresponding to the speed of the sheets and, therefore, the sheets do not slide over any stationary surface.

Once trapped between the two sets of high-speed belts, the upper and lower delivery sections are the same. Because the sheets are subject to the same operations, only one delivery section will be described. The delivery sections decelerate and shingle the sheets so that they are in a format for delivery to a counter and stacker operation. A similar delivery system is described in my pending application Ser. No. 768,897, however, the delivery sections of the present invention contain important differences and improvements which will become apparent upon comparison.

In operation of either the upper or lower delivery section, the sheets are fed into the deceleration and shingling portion at high speed by opposed, face to face, high-speed conveyor belts. The lower, high-speed conveyor belt ends short of the deceleration and shingling portion. A low-speed conveyor belt begins just downstream of the terminating end of the lower, high-speed conveyor belt and is dropped relative to the plane of the latter. Also, the continuing upper, high-speed belts as well as the lower, low-speed belts are slightly declined at a downward angle of approximately three degrees. This ensures that the sheets exiting between the opposed, high-speed belts maintain contact with the continuing upper, high-speed belts.

As the leading edge of the sheet emerges from between the opposed, high-speed belts a series of dual snubber wheels freely mounted on rotating snubber support plates, timed with the rotation of the knife cylinder, strip the leading edge of the sheets off the upper high-speed belts. As the sheets continue their forward travel one set of the dual snubber wheels drives the sheets downwardly and against the low-speed belts. Because the sheets are continuing their forward movement the snubbers actually trap the tail end of each sheet against the low speed belt. However, the physical trapping of the sheets between the snubbers and the low-speed belts, resulting in the necessary deceleration of the sheet for shingling, occurs while the tail edge of the sheet is still held between the opposed, high-speed belts or just following the departure of the sheet therefrom. By decelerating the sheets in this manner, not only are the sheets always subject to positive control, thus preventing the sheets from coming out of alignment and creating a jam or foul, but the invention prevents damage to the sheets. Perhaps more importantly, because the sheets are maintained in alignment, there is no need for a squaring roller. Without a squaring roller, the system can be operated at speeds well in excess of 300 feet per minute.

The preferred embodiment employs dual snubber wheels, positioned 180 degrees apart, rather than single snubber wheels, to provide longer contact with the sheets, thereby allowing greater control and positive deceleration. The snubbers rotate at a one to one ratio with the knife cylinder which cuts four sheets for every single rotation and the snubbers. However, because the sheets are alternately diverted between the upper and lower delivery sections, a gap exists between the sheets and the snubbers must only decelerate two sheets per revolution. Having two snubber wheels 180 degrees apart, the snubber wheels can maintain longer contact with the individual sheets than if the snubber had only one wheel. A single wheel snubber would have to rotate at twice the speed in order to match the output of the knife cylinder. Moreover, if there was no gap between the sheets, but instead, one sheet was immediately behind the next sheet, the time for deceleration would be drastically reduced. As a result, more snubbers would have to be added. The two snubbers of the preferred embodiment of the present invention would not be able to sufficiently slow the sheets if the deceleration time was reduced. Consequently, a more efficient system is achieved by the present invention by alternately diverting the sheets prior to deceleration and, thereby, using fewer snubbers to achieve the desired deceleration.

As the sheets are decelerated and laid flat against the low-speed belts, the snubber wheels continue their rotation in the direction of sheet travel and lift off the surface of the sheet just as the leading edge of the next sheet is emerging from between the opposed high-speed belts. At this point, the second set of snubber wheels engage the lead edge of tis sheet and decelerate the sheet in the same manner as previously described. However, the previous sheet, traveling at a slower speed, is overlapped by this next succeeding sheet thereby achieving the desired shingling of the sheets. The specific length of the shingle or overlap is readily adjustable by changing the speed of the lower, low-speed belt. Additionally, downstream of the dual snubber wheels, it is desirable to have a plurality of controlling rollers positioned to trap the leading edge of each succeeding sheet. The controlling rollers should be positioned so that the leading edge of each sheet is engaged before the next subsequent sheet is decelerated against it by the snubbers. This will prevent the underlying sheets from becoming misaligned and jamming the system. Once in a shingled or overlapped format, the sheets are delivered to the next process such as counting and stacking.

BRIEF DESCRIPTION OF THE DRAWINGS

To provide for a more complete understanding of this invention, a preferred embodiment of the invention is illustrated in greater detail in the accompanying drawings.

DETAILED DESCRIPTION

The following detailed description will permit a more complete understanding of this invention. However, the embodiment described below is simply an example of the invention and the invention is not limited to this embodiment. Furthermore, the drawings are not necessarily to scale and certain elements may be illustrated by graphic symbols and fragmentary views. In certain instances, details may have been omitted which are not necessary for an understanding of the present invention, including conventional details of fabrication and assembly.

Generally, the present invention relates to a system for cutting a continuous paper web into separate sheets or signatures, alternately diverting the individual sheets to one of two paths, thereby creating a space or gap between successive sheets, and then decelerating and shingling the successive sheets for delivery to a subsequent processing station. The device of this invention is intended to be integrated into a full service printing system, and will supply shingled sheets of printed material to a subsequent processing station such as a counting and stacking operation.

Figure 1:
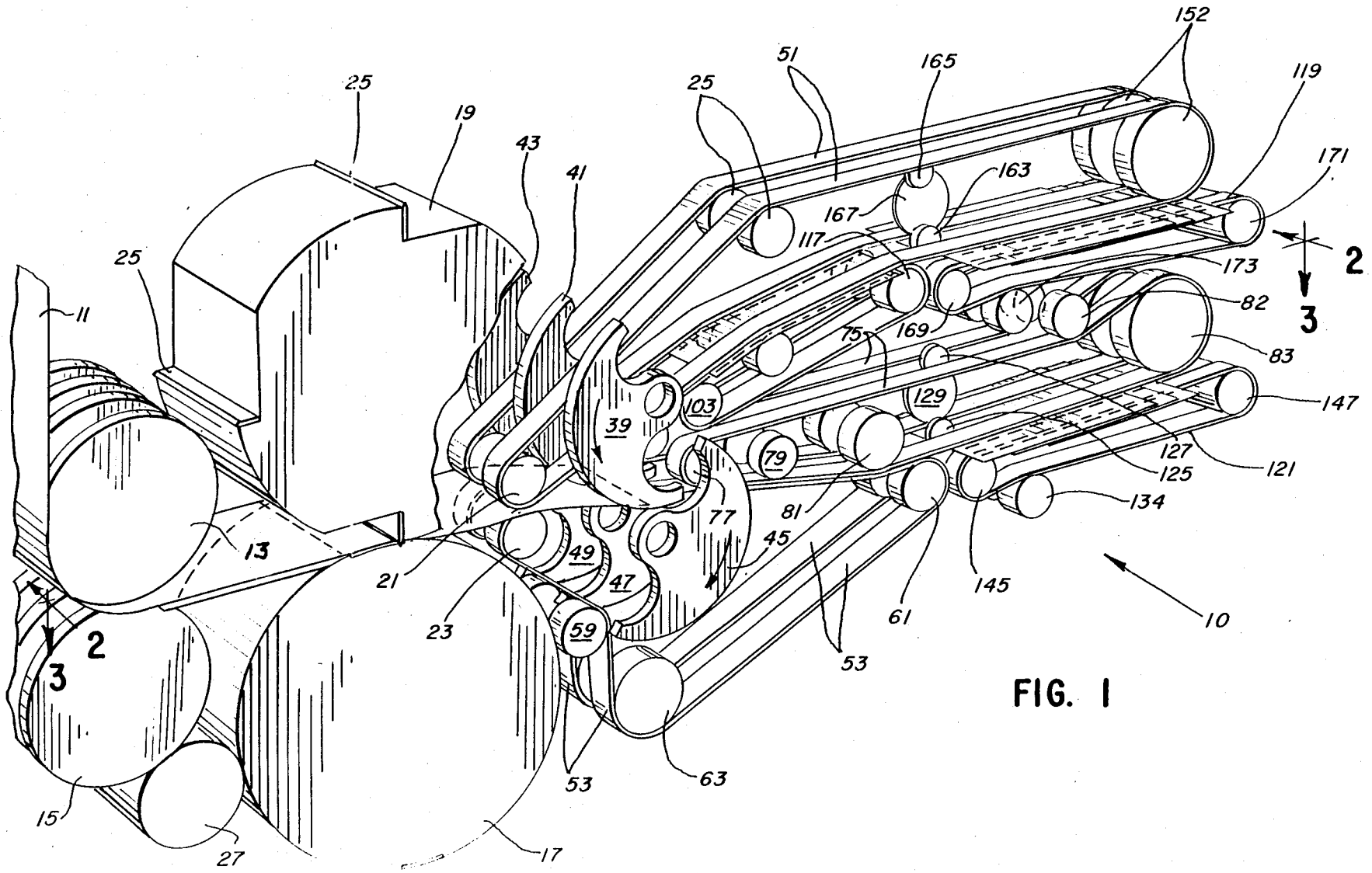
FIG. 1 is a perspective view of the sheet diverter and delivery system with much of the structure removed for clarity.

Turning to the drawings, FIG. 1 shows a perspective view of the sheet diverting and delivery system 10 of the present invention. Much of the frame structure is not shown to more clearly illustrate the belt, roller and cam configurations of the diverter and delivery sections.

A continuous web of paper 11 is drawn into the sheet diverting and delivery system 10 between opposed nip rollers 13 and 15 at high speed, e.g., 2000 feet per minute. The leading edge of the web passes between the anvil cylinder 17 and the rotary knife cylinder 19 and engages a second pair of opposed nip rollers 21 and 23. These nip rollers 21 and 23 rotate at a velocity approximately eight percent faster than the speed of the incoming web 11, and the resulting acceleration of the lead edge of the web creates tension in that portion of the web between the first set of nip rollers 13 and 15 and the opposed nip rollers 21 and 23 passing between the anvil cylinder 17 and rotary knife cylinder 19. As the web is held firmly in place and under tension as a result of the action of these nip rollers 21 and 23, one of the four blades 25 of the rotary knife cylinder 19 rotates into position and cuts a sheet from the web 11.

Although it is preferred that the leading edge of the web is received by the opposed nip rollers 21 and 23 before the web is cut by a knife blade 25, this is not necessary. For example, the construction of a particular embodiment of a sheet diverter in accordance with my invention may position the knife cylinder 19 a significant distance upstream of the nip rollers 21 and 23 and/or may have the direction of the web exiting the knife cylinder different than the input feed direction of the nip rollers 21 and 23. To prevent the cut sheet or signature from coming out of alignment between the knife cylinder 19 and the nip rollers 21 and 23 in this circumstance, however, the cut sheet or signature should be conveyed over the intervening distance under substantially continuous control, as by closely spaced, face-to-face conveyor belts.

In the preferred embodiment the knife blades 25 are straight but it is also possible to use serrated blades. In such a case, however, the anvil surface would need to be constructed of some type of resilient material such as urethane or the anvil would need slots for the tips of the serrated blades to recess during cutting.

Figure 3:
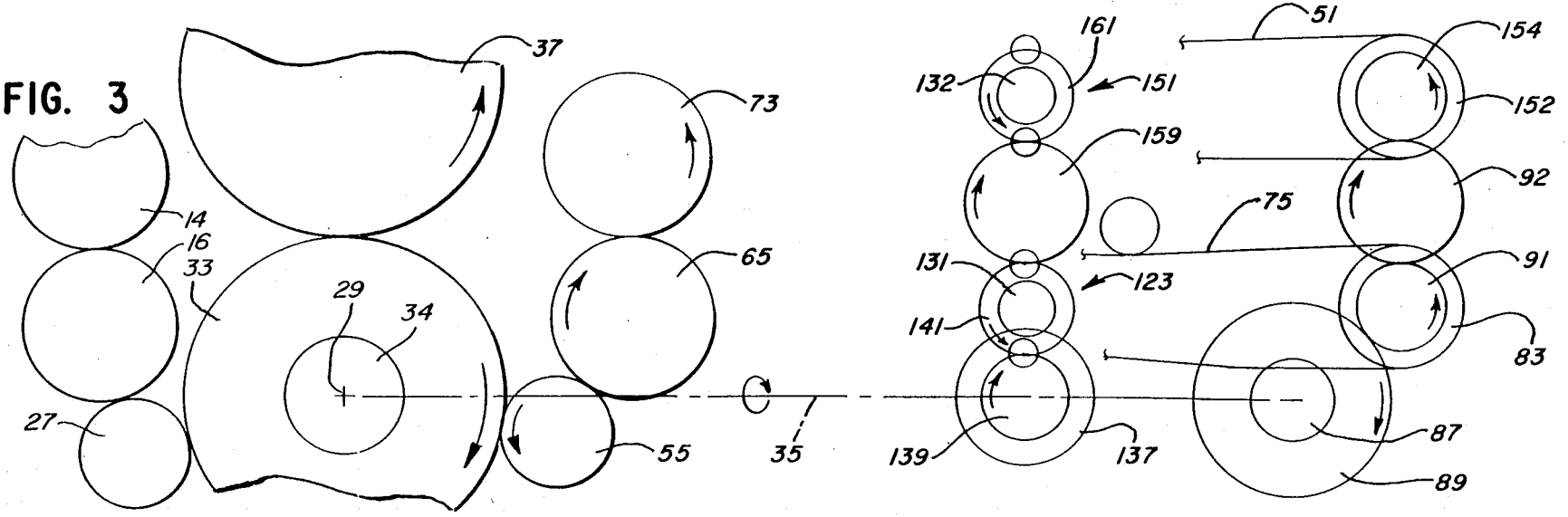
FIG. 3 is a diagrammatic elevational view of the sheet diverter and delivery system showing a portion of the gear drive.
Figure 4:
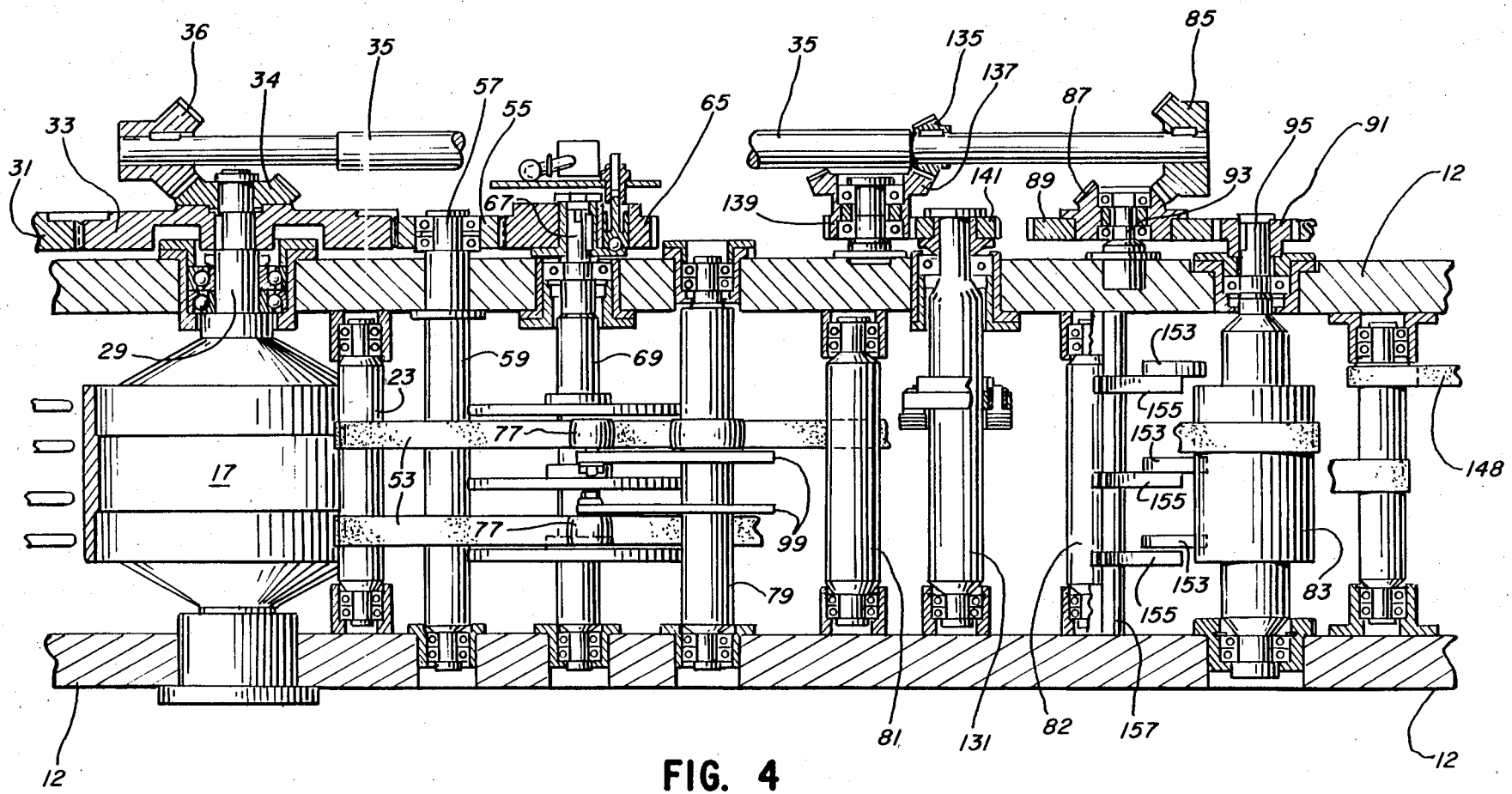
FIG. 4 is a cross-sectional and partial cutaway view of the diverter and delivery system taken about line 4—4 of FIG. 2.

As shown in FIG. 4, the anvil cylinder 17 is rotatably mounted to the frame 12 by means of an axle 29 housed within appropriate bearings as is well known in the art. Power is supplied to the anvil cylinder 17, and consequently to the rest of the diverter and delivery system, from a printing press (not shown) through the drive gear 31 engaging the main drive gear 33 on the anvil cylinder axle 29 as shown in FIGS. 3 and 4. By being directly driven by the printing press, proper timing between the respective sections of the entire operation is ensured.

The nip rollers 13 and 15 are rotatably mounted to the frame 12 by means of axles housed within appropriate bearings (not shown). These nip rollers 13 and 15 each have a corresponding drive gear 14 and 16, respectively (FIG. 3), mounted on the axle about which the nip rollers rotate. The infeed nip roller gear 16 is in contact with, and is driven by the interconnecting drive gear 27 which, in turn, is in contact with and is driven by the main drive gear 33 fixably mounted on the axle 29 of the anvil cylinder 17. The interaction between the nip roller gear 14 and the nip roller gear 16 causes the nip roller 13 to rotate.

By changing the size of the lower nip roller 15, the speed of paper feed can be adjusted and, therefore, the length of sheets cut from the web easily adjusted. For example, making the lower nip roller 15 smaller will cause the web speed to decrease. Consequently, the sheets cut by the knife cylinder 19 will be shorter. The converse is true if the nip roller 15 is made of larger diameter. Additionally, to allow this adjustability, it will be necessary to place the axles of both the lower nip roller 15 and the interconnecting drive gear 27 on eccentrics to allow for vertical adjustment in accommodating any changes in size of the roller.

Figure 2:
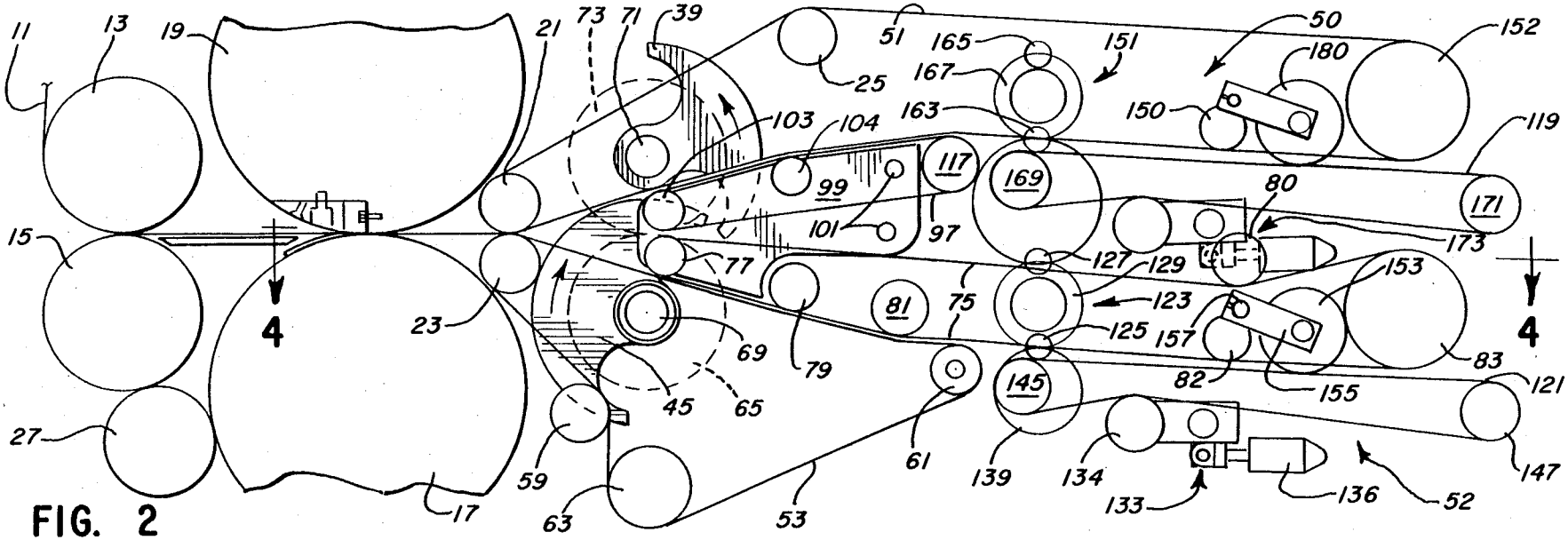
FIG. 2 is a cross sectional view of the primary elements of the sheet diverter and delivery system.

The rotary knife cylinder 19 is rotatably mounted to the frame 12 by means of the knife cylinder axle and bearing assembly (not shown) disposed in overlying relation to the anvil cylinder 17. The four knife blades 25 are affixed to the rotary knife cylinder 19, by commonly known means at 90° intervals, as shown in FIG. 2. The rotary knife cylinder 19 and the anvil cylinder 17 are positioned so that the cutting edge of each blade 25 will just contact the anvil cylinder at the lowest point in the rotation path of the blade 25. Of course, the vertical position of the rotary knife cylinder 19 and the cutting blades 25 may be adjusted to accommodate signatures or sheets of varying thicknesses.

As also shown in FIG. 4, the drive shaft 35 supplies power to the diverter and delivery sections of the present invention through the main drive gear 33 driving a bevel gear 34 mounted on the anvil cylinder axle 29, which bevel gear 34 drives receptive bevel gear 36 mounted on the drive shaft 35. The main drive gear 33 drives the rotary knife cylinder 19 by means of a knife cylinder gear 37, shown in FIG. 3, mounted on the rotary knife cylinder axle (not shown). The size of the anvil cylinder 17 and the knife cylinder 19 as well as the respective drive gears 33 and 37 are appropriately selected so that the knife cylinder 19 and anvil cylinder 17 rotate at a ratio of 1 to 1.

After the sheet is cut from the web 11, it continues to be drawn into the nip of the opposed nip rollers 21 and 23 until it contacts either the rotating upper diverter cams 39, 41 and 43 or the lower diverting cams 45, 47 and 49. As is best seen in FIG. 1, the rotating diverting cams are positioned and synchronized so that sheets are alternately directed toward either the upper delivery system 50 or the lower delivery system 52. The upper nip roller 21 is a part of the conveyor system defined by a pair of upper, high-speed belts 51, while the lower nip roller 23 is a part of the conveyor system defined by belts 53. In the preferred embodiment of the present invention the nip rollers 21 and 23 are rotating at a surface velocity approximately eight percent greater than the speed of the web 11. Consequently, each successive sheet experiences a slight acceleration as it is cut from the web.

Other arrangements of diverter cams and conveyor belts are possible. For example, whereas the drawings show three diverter cams spanning two conveyor belts on each of the upper and lower diverting systems (e.g., FIGS. 1 and 4), a different number of belts and diverter cams can be chosen. In one actual embodiment, each diverting system includes three spaced apart conveyor belts and four diverter cams, where a diverter cam is positioned close to the inner edge of each of the two outer belts and the remaining two diverter cams flank the third, inner belt. Regardless of the chosen arrangement, however, it is preferred that the outer diverter cams be axially positioned so that the transverse edge portions of a cut sheet or signature are supported by the diverter cams during the diverting operation.

In this connection, an important feature of my invention becomes apparent. The diverter cams may be transversely displacable along their common axis of rotation, unlike prior diverting systems that utilize fixed, stationary steeples which preclude this flexibility. Thus, diverter cam 39, 41, 43 may be selectively positioned along camshaft 71 and diverter cams 45, 47, 49 may be selectively positioned along camshaft 69. The belts 51 and 53 may also be transversely displacable by laterally moving the rollers around which a belt travels. Owing to the flexibility of this construction, the sheet diverter of my invention is able to accept sheets or signatures of any width. For example, if a signature of a relatively wide width is to be processed, the belts and/or diverter cams of the upper and lower diverting systems can be spread further apart. For a minor adjustment of signature width, only the outer diverter cams or belts need be repositioned.

Line 4–4 of FIG. 2 defines the center line of the system. The function and structure of the components above line 4–4 is largely the same as that below the line. A top view of the lower structure is shown in greater detail in FIG. 4 and will be described in detail below.

As seen in FIG. 4, the main drive gear 33 engages gear 55 mounted on the end of axle 57. Axle 57, in turn, supplies rotational power to the drive roller 59. The drive roller 59 is in contact with the pair of friction belts 53, FIG. 2, which belts 53 constitute the lower, high-speed conveyor system of the lower diverter and delivery sections of the invention. The belts 53 also traverse the nip roller 23 and the idler rollers 61 and 63. Preferably, the ratio between the main drive gear 33 and gear 55 is such that drive roller 59 drives the lower, high-speed belts 53 at a speed approximately eight percent faster then the speed of the incoming continuous web 11 of paper.

The drive roller gear 55, in turn, drives the lower camshaft gear 65 mounted on the lower camshaft axle 67 of the lower diverter camshaft 69 which is rotatably mounted in the frame 12 in appropriate bearing means. The lower diverting cams 45, 47 and 49 are rigidly mounted on the lower camshaft 69.

As shown in FIGS. 1 and 2, an upper diverting system similar to the lower diverting system just described is disposed above the lower diverting system. This upper diverting system employs a set of upper diverting cams 39, 41, 43 mounted on an upper camshaft 71 which is mounted in the frame 12 in the same manner as the lower camshaft 69. As seen in FIGS. 2 and 3, the upper camshaft 71 is directly driven by the lower camshaft 69 through the engagement of the upper camshaft gear 73, mounted on the upper camshaft 71, and the lower camshaft gear 65 mounted on the lower camshaft 69. Thus, the upper and lower camshafts 71 and 69 rotate at the same speed, but in opposite directions. Furthermore, the upper and lower rotating diverter cams are positioned and synchronized so as to alternately engage the successive sheets continuously cut from the web and entering the diverter section of the present invention. Preferably, the surface speed of the diverter cams is the same as or slightly more than the speed of the incoming sheet, again minimizing the possibility of a jam as well as static electricity. Necessarily, the configuration of driving gears between the anvil cylinder 17 and the camshafts is such that the camshafts complete two revolutions to every single revolution of the knife cylinder 19 and the anvil cylinder 17.

Compared to prior diverting systems, e.g., U.S. Pat. 4,373,713, the diverter cams of my invention are of a relatively greater radius and are positioned further downstream of the nip rollers 21 and 23. Because of the greater radius of the diverter cams, an incoming sheet engages a flatter surface on the diverter cams and therefore the lead edge of the sheet has a less of a tendency to buckle or otherwise be damaged on contact with the diverter cams. By positioning the diverter cams slightly further downstream, the angle through which a sheet must be diverted by the diverter cams is decreased, also reducing the chance of damage to the sheet by requiring a more moderate diverting action. Of course, to minimize the occurrence of lead edge damage in connection with both diverting paths, the angle of diversion should be the same for both paths.

A sheet destined for the lower delivery system will pass between the pair of opposed front nip rollers 21 and 23 and will be positively controlled therebetween until the upper rotating diverter cams 39, 41 and 43 contact the sheet and guide it against the pair of lower, high-speed belts 53. As the sheet continues into the lower delivery system between diverter cams 39, 41 and 43 and belts 53, the leading edge of the sheet enters the nip created between the opposed upper, high-speed belts 75 and the lower, high-speed belts 53 before the trailing edge exits the grasp of the opposing nip rollers 21 and 23. Moreover, the surface shape of the cams ensures that the entire length of each sheet is supported between the opposed nip rollers 21 and 23 and the opposed, high-speed belts 53 and 75. This further ensures continued positive control of the sheets during this same length of travel. The sheet is released by the diverter cams 39, 41 and 43 only after the sheet has been positively engaged between the opposed belts 53 and 75, and the sheet thereafter continues to proceed between these belts toward the lower delivery section 52.

The upper, high-speed belts 75 traverse a series of idler rollers 77, 79, 80, 81 and 82 and a drive roller 83. The drive roller 83 drives these belts 75 by frictional engagement. A bevel gear 85 mounted on the drive shaft 35 supplies rotary power to the drive roller 83 through the combination of the receptive bevel gear 87 the transfer gear 89 and the drive roller gear 91. Both the receptive bevel gear 87 and the transfer gear 89 are mounted on an axle 93 which axle is rotatably mounted in the frame 12 in appropriate bearing means. The transfer gear 89 drives the drive roller gear 91 which is fixed on the drive roller axle 95 of the drive roller 83. The drive roller 83 rotates about the drive roller axle 95 which axle 95 rotates in the frame 12 in an appropriate bearing means.

Once a sheet has been diverted into the lower delivery system by the upper diverter cams 39, 41 and 43 the lower diverter cams 45, 47 and 49 rotate into position to guide the next succeeding sheet exiting the opposed nip rollers 21 and 23. This next sheet will be positively guided and supported by diverting cams 45, 47 and 49 against the upper, high-speed belts 51 until the sheet has totally passed between opposed upper, high-speed belts 51 and lower, high-speed belts 97. Thus, the continuous stream of cut sheets is alternately delivered between the upper delivery section and the lower delivery section. By alternately diverting each sheet in this manner, every sheet is separated from the next sheet by a distance greater to the length of a sheet. This gap allows the delivery sections to function. As further seen in FIG. 4, the initial idler rollers 77 are rotatably mounted on the plates 99. These plates 99 are, in turn, mounted on the shafts 101 affixed to the frame 12. The idler rollers 103 of the upper diverter system are similarly attached to the plates 99. In order to accommodate sheets of varying widths, these plates 99, and consequently, the idler rollers 77 and 103 are laterally adjustable along the shafts 101. Similarly, the upper and lower diverting cams are laterally adjustable along the respective camshafts and the upper and lower, high-speed belts are laterally adjustable as well. The lateral adjustability is desirable in order that the edges of the individual sheets are always supported to thereby avoid the edges becoming torn or possibly jamming the system.

Figure 5:
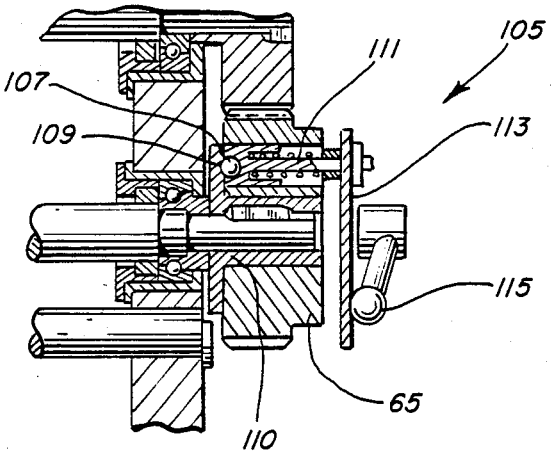
FIG. 5 is a cross-sectional view of a safety clutch system that with the present invention.

As a safety feature, in the preferred embodiment, the diverters also act as jam detectors. Each camshaft 69 and 71 may be provided with a clutch assembly to allow the camshaft axle as well as the supporting gears to continue rotating if the sheets should jam and stop the movement of the diverter cams. As can be seen best in FIGS. 4 and 5, in connection with the lower camshaft but equally applicable to the upper camshaft, the lower camshaft gear 65 which drives the lower camshaft 69 may contain a clutch assembly 105. The clutch assembly 105 comprises a ball bearing 107 which is forced into a detent 109 in the axle bushing 110 by the spring biased member 111. The spring biased member 111 is, in turn, connected to a clutch plate 113 at its distal end, which clutch plate, when extended outwardly, trips a system shutdown switch 115. In operation, the camshaft gear 65 rotates the camshaft 69 by means of the ball bearing 107 positioned in the detent 109. Should the paper jam and the diverter cams stop rotating, the axle bushing 110 will also stop. However, instead of stripping the gears, the ball bearing 107 will be forced out of the detent 109 pushing the clutch plate 113 out and activating the system shutdown switch 115. The switch shuts down the printing press and also activates two pneumatic cylinders operatively connected to the axle of the nip roller 13 thereby lifting the eccentrically mounted upper nip roller 13 off of the web of paper. This action immediately stops the flow of paper into the diverting section thereby preventing damage to the machine. Additionally, because the gear 65 is no longer connected to the axle bushing 110, the gear can continue to rotate while the system loses its momentum and finally stops as a result of the printing press being shut down.

A sheet exiting either the outgoing nip of the high-speed belts 51 and 97 at the drive roller 117 of the upper conveyor system, or the nip of the high-speed belts 53 and 75 at the idler roller 61 of the lower conveyor system, tends to adhere to the lower surface of the continuing upper belts 51 and 75, respectively, because each of these upper, high-speed belts are declined at an angle of approximately three degrees rather than being parallel to the ground. Disposed below the upper, high-speed belts 51 and 75 and adjacent to, but on a lower plane than, the respective lower, high-speed belts 97 and 53, are the upper and lower, low-speed delivery conveyor systems 50 and 52 defined by the low-speed belts 119 and 121, respectively. These lower, low-speed belts may also be declined at approximately three degrees. This slight downward decline ensures that the sheets will adhere to the upper, high-speed belts so that the next subsequent sheet does not collide with the tail of the previous decelerated sheet which may have dropped into its path otherwise.

In the lower delivery section 52, the sheets emerge from between the opposed, high-speed belts 53 and 75 where they are promptly decelerated and shingled for delivery to a subsequent handling process. The pair of lower, low-speed belts 121 move at a speed approximately one-sixth or one-seventh the speed of the belts 53 and 75. The sheets are decelerated by means of a plurality of snubber assemblies 123 each comprised of a pair of snubber wheels 125 and 127 freely rotatable on the snubber support plates 129. The snubber support plates 129 are mounted to a snubber shaft 131 which is driven at a ratio of 1 to 1 with respect to the rotation of the rotary knife cylinder 19. Because the knife cylinder makes four cuts for each revolution and alternate sheets are diverted in the diverter section to one of the two delivery sections, two sheets will be introduced to the snubber assemblies of each delivery section for every revolution of the snubber assembly. Thus, the snubber assemblies will rotate at one half the speed of the single-wheeled snubber of the prior art, which must rotate once for every sheet.

Figure 6:
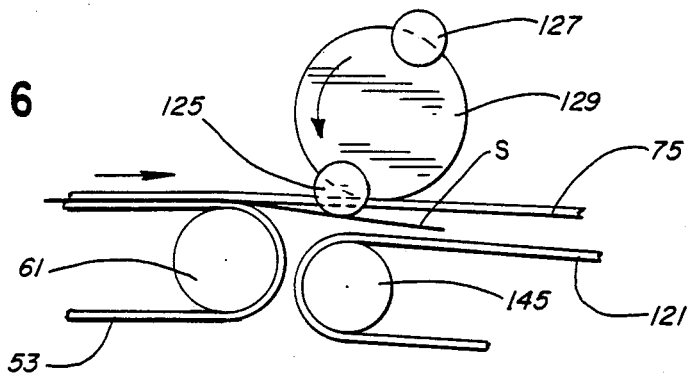
FIGS. 6, 7 and 8 illustrate in greater detail the operation of the sheet snubber assemblies of the present invention.
Figure 7:
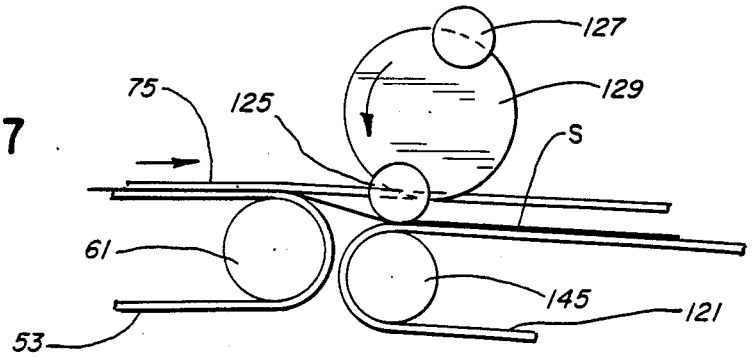
Figure 8:
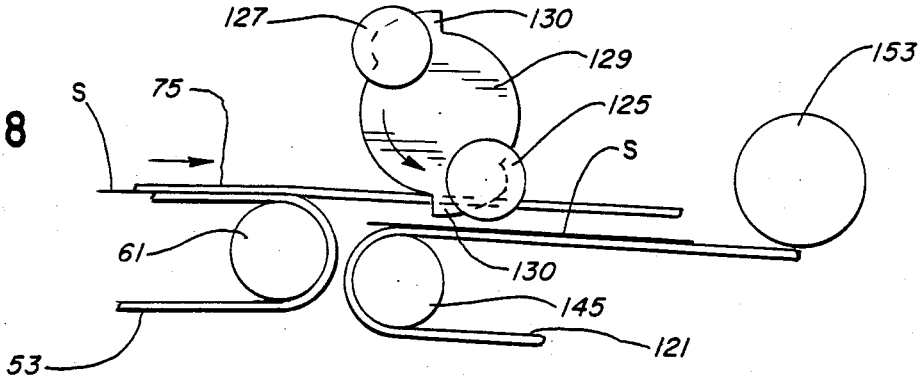

As shown in greater detail in FIGS. 6, 7 and 8, in connection with the lower delivery section, with the termination of the lower, high-speed conveyor system the individual sheets S emerge from between opposed, high-speed belts 53 and 75. The snubber wheels 127 or 125 then engage the incoming sheet in the middle area of the sheet and strip the front portion of the sheet from the upper, high-speed belts 75 while the rear portion of the sheet S is still positively controlled between the opposed, high-speed belts 53 and 75. As the sheet S continues forward and the snubber support plates 129 continue to rotate, the sheet is pressed against the lower, low-speed belts 121, thereby decelerating the sheet. Because the snubber wheels 125 and 127 are freely rotatable, they are free to adapt to the speed of the snubbed sheet S and the sheet is undamaged during its rapid deceleration. The snubber wheels 125 and 127 may be manufactured from resiliently deformable or compressible material, such as rubber, to further prevent damage to the sheets upon impact of the snubber.

It is important that the actual snubbing of the sheet S occur while the tail of the sheet S is still trapped between or has just immediately left the opposed, high-speed belts 53 and 75. This continuous positive control of the sheets ensures that the sheets will not become misaligned and potentially foul or jam the system. Additionally, a deckplate (not shown) may be positioned beneath the lower, low-speed belts to provide a solid platform against which the snubber wheels can trap the respective sheets. Without a deckplate the snubbers trap the sheets against the unsupported lower, low-speed belts, which may lead to undesirable bouncing of the low-speed belts during operation. Consequently, the tension in the low-speed belts 121 must be regulated by a tensioning means 133 in order to provide sufficient opposing support during snubbing. In an actual embodiment of the invention, no deckplate was used, and this was found to result in a favorable, longer duration of contact between the snubbing wheels and the snubbed sheet.

The snubber assembly of the lower delivery system is driven by a gear train consisting of a bevel gear 135, a receptive bevel gear 137, a transfer gear 139 and the snubber shaft gear 141. The bevel gear 135, mounted on the drive shaft 35, engages the receptive bevel gear 137 mounted on the end of the transfer axle 143. Also affixed to the transfer axle 143 is the transfer gear 139 which drives the snubber shaft gear 141 mounted on the snubber shaft 131. The snubber shaft 131 is rotatably mounted to the frame 12 by appropriate bearing means. The ratio of revolutions of the knife cylinder to the snubber shaft is 1 to 1.

As best seen in FIG. 2, the lower, low-speed belts 121 traverse an idler roller 145 and a drive roller 147. The drive roller 147 is driven by a separate, variable speed motor (not shown) by belt 148 (FIG. 4) to allow variation of the speed of the lower, low-speed belts 121 independent of the remainder of the system. This allows the length of overlap, when shingling the sheets, to be varied. For example, the shingling may be shortened by decreasing the speed of the belts 121 so that each incoming sheet is snubbed against a previously snubbed and laid down sheet, thereby providing further control over the previously laid down sheet. If the lower, low-speed belts 121 were driven by the drive shaft 35, the only way to vary the length of sheet overlap would be to change the gear ratios by physically changing the gears.

The snubber wheels 125 and 127, mounted on the snubber support plate 129, snub the sheets against the flat belts 121 slightly before the lowest point of their rotation, thereby decelerating the sheets. The tensioning means 133 permits adjustment of the amount of tension on the belts 129. In the preferred embodiment depicted in FIG. 2, the tensioning means 133 includes a tensioning roller 134 in rotational contact with the belts 121. The belts 121 are subject to constant tensioning through the tensioning roller 134 by the pneumatic tensioning means 136 commonly known in the art. Of course, any other suitable tensioning device can be used to control the tension in the low-speed belts.

Once the sheet has been decelerated by the snubbers, it is now laid flat against the lower, low-speed belts 121 and travelling at a much reduced speed. Simultaneously, the snubber wheels 125 are lifting off the sheet and the next subsequent sheet is emerging from between the opposed, high-speed belts 53 and 75. The snubber support plates 129 continue their rotation and the second snubber wheels 127 now positively guide and trap the next subsequent sheet in the same manner as previously described. However, the next subsequent sheet, travelling at a higher speed, is caused to overlap the previous sheet thereby achieving the desired shingling of the sheets. The length of the overlap is determined by the speed of the lower, low-speed belts 121. The upper snubber assembly 151, described below, operates in the same manner.

As seen in FIG. 8, the snubber support plate 129 may be provided with a pair of masks 130 which act to dampen any movement of the sheets after the snubber wheels lift off the sheet surface.

In a similar vein, the plurality of snubber assemblies for each delivery section may be angularly offset relative to one another. Particularly, in an actual embodiment having four snubber assemblies in each delivery section, the outer snubber assemblies were mounted so as to follow the inner snubber assemblies by approximately 5° . In operation, the snubber wheels of the inner, relatively advanced snubber assemblies engage an incoming sheet before the lagging, outer snubber wheels engage the sheet, and the snubbing action of the outer snubber wheels persists after the inner snubber wheels have left the sheet. It is seen that the overall snubbing operation is lengthened, thus ensuring a more positive snubbing action. Further, the lagging, outer snubber assemblies assist in reducing the undesirable flapping and folding of the trailing edge of the sheet, particularly at the outer edges and corners of the sheet where such effects are likely to occur.

Downstream of the snubber area are a plurality of controlling rollers 153 for maintaining alignment of the now shingled stream of sheets. The controlling rollers 153 are rotatably mounted on the arms 155 which arms 155 are attached to the controlling roller shaft 157. In operation, the controlling rollers 153 and the arms 155 are free to follow the height of the stream of shingled paper. Also, the controlling rollers 153 maintain a positive control over the sheets to prevent misalignment of the sheets. Moreover, the controlling roller shaft 157, and consequently the controlling rollers 153, are also horizontally adjustable along the sheet path. This adjustability is important for maintaining positive control over the sheets when sheet lengths are changed. Specifically, before a sheet is decelerated by the snubbers, the previous and now underlying sheet comes within the positive control of the controlling rollers 153. In this way, when the sheet is decelerated against the previous sheet, the previous and underlying sheet cannot become misaligned and foul the system.

The elements of the upper diverter and delivery system are functionally the same as the corresponding elements described previously with respect to the lower diverter and delivery system, although the elements of the upper system are not shown in detail.

As a sheet emerges from between the opposed front nip rollers 21 and 23, the lower diverter cams 45, 47 and 49 guide the sheet against the upper, high-speed belts 51 and support the sheet against the upper, high-speed belts 51 until the sheet totally passes between the opposed upper, high-speed belts 51 and lower, high-speed belts 97 of the upper delivery section. The upper, high-speed belts 51 and the lower, high-speed belts 97 then deliver the sheets to the snubbing area of the upper delivery system 50. The upper, high-speed belts traverse idler rollers 21, 25 and 150 and a driving roller 152. The drive roller 152 is driven by a drive gear 154 mounted on the end of the axle of the drive roller 152. The drive gear 154, in turn, is driven by the drive gear 91 of the drive roller 83 of the lower delivery section 52 by means of the interconnecting gear 92 (FIG. 3). The lower, high-speed belts traverse the idler rollers 103 and 104 and a drive roller 117. The drive roller 117 is driven through a gear linkage to the drive shaft 35 (not shown).

The upper snubber assembly 151, as seen in FIG. 3, is driven by the lower snubber shaft gear 141 on the lower snubber shaft 131 through gear 159 engaging upper snubber shaft gear 161. This allows both snubber shafts 131 and 132 to rotate at the same ratio as the anvil cylinder 17 and the rotary knife cylinder 19. However, the snubber shafts, being of smaller diameter, rotate slower thereby allowing the snubber wheels to remain in longer contact with the individual sheets during deceleration.

The upper snubber assembly 151, like the lower snubber assembly 123, comprises two rotatably mounted snubber wheels 163 and 165 rotatably mounted on the snubber support plates 167. The lower, low-speed belts 119, against which the upper snubber system 151 traps and decelerates sheets, traverses an idler roller 169 and a drive roller 171. The drive roller 171, as with the drive roller 147 of the lower delivery system, is driven by a variable speed motor for reasons also described previously. Similarly, for deceleration purposes, the lower, low-speed belts 119 are subject to continuous tensioning means 173. Additionally, a deckplate may be inserted beneath the lower, low-speed belts, at the point the snubbers contact the lower, low-speed belts 119, to assist in decelerating the sheets and to obviate the need for the tensioning means. However, deck plates increase static in the system which is highly undesirable. Also, as described in connection with the lower delivery system 52, once the sheets are laid flat and are being shingled, a series of controlling rollers 180 maintain positive control over the sheets as they are conveyed to the next operation.

An alternative embodiment to the present invention would add an additional pair of opposed nip rollers downstream of the nip rollers 21 and 23 which mark the entry to the diverting section. These additional nip rollers would be located inside the path of the diverting cams and would be mounted on the plates 99 in the same manner as the idler rollers 77 and 103, previously described, are presently mounted. This structure would allow the diverter cams to rotate unobstructed. In this arrangement, both these newly added opposed, nip rollers as well as the nip rollers 21 and 23 would be horizontally adjustable along the conveyor path. This additional nip will act to further stabilize and control the individual sheets as they are cut from the web by delaying the diverting action until the sheets are held between both sets of opposed nip rollers.

While the above description only shows one embodiment of the invention, the invention is not limited thereto since one may make modification, and other embodiments of the principles of this invention will occur to those skilled in the art to which the invention pertain, particularly upon considering the foregoing teachings.

What is claimed is:

1. A sheet diverter and delivery system for receiving a fast moving, continuous web, cutting sheets therefrom and diverting alternate sheets to one of two delivery paths for subsequent processing, all while maintaining substantially continuous control of the individual sheets, comprising:

first conveyor means including cutting means for cutting a fast moving continuous web into a stream of separate sheets and directing the sheets along an original travel path at an original speed;

sheet controlling means disposed downstream of said first conveying means and along the original travel path of said first conveying means to securely engage the lead edge of the web before it is cut;

second conveyor means and third conveyor means each having an entrance end and an exit end and each including at least a pair of closely spaced face to face belts, said entrance ends being positioned downstream of said sheet controlling means, said second conveyor means disposed above said third conveyor means, said second and third conveyor means being driven at a speed at least approximately the original speed of the sheets and being positioned on alternate sides of the original travel path and diverging from the original travel path at approximately the same angle;

a pair of rotating diverter means positioned in close proximity to the entrance ends of said second and third conveyor means for alternately diverting the separate sheets from the original travel path into said second and third conveyor means without the use of a stationary diverter or guide member, each of the diverter means being synchronized with the speed of the one of the second and third conveyor means with which the diverter means is associated to engage the leading edge of the sheet to be diverted at a sufficiently small angle and directly divert the leading edge of the sheet under substantially continuous control into the grasp and control of the associated conveyor means before the trailing edge of the sheet is disengaged from said sheet controlling means so as to avoid damage and misalignment of the sheet, the diverter means thereafter continuing to support substantially the entire length of the sheet as the sheet is taken up by the associated conveyor means and ultimately released by said sheet controlling means; and means connected with each of said second and third conveyor means for decelerating and shingling said sheets for delivering two separate streams of shingled sheets to a subsequent processing station.

2. A sheet diverter and delivery system as set forth in claim 1 wherein said pair of diverter means are disposed adjacent the entrance end of said second and third conveyor means and adapted to rotate in opposite directions, each of said pair of diverter means comprising a plurality of axially spaced, rotating diverting cams.

3. A sheet diverter and delivery system as set forth in claim 1 wherein said cutting means comprises a rotary cutting cylinder having at least one knife blade and an opposed anvil cylinder whereby the continuous web of printed paper is run between said cutting cylinder and anvil cylinder and cut into separate sheets.

4. A sheet handling system for receiving a fast moving, continuous web, cutting sheets therefrom, and diverting alternate sheets to one of two delivery paths for subsequent processing, all while maintaining substantially continuous control of the individual sheets, comprising:

a cutting means for receiving the web and cutting the web into individual sheets, thereby forming a fast moving stream of cut sheets travelling at an original speed along an original travel path;

conveyor means positioned downstream of the cutting means and defining an entrance end having a pair of opposed rollers which securably engage the leading edge of each sheet before it is cut from the web and further defining first and second delivery paths for receiving sheets from said opposed rollers and transporting the sheets to predetermined points of delivery at a speed at least approximately the original speed of the sheets, the delivery paths being disposed on opposite sides of the original travel path of the sheet leaving the cutting means and at least initially diverging from the original travel path at approximately the same angle, each delivery path being at least partially defined by a conveyor system of closely spaced face to face belts having an entry portion and an exit portion downstream of the entry portion, said exit portion forming the point of delivery for that delivery path, in each of which delivery paths a sheet is transported under substantially continuous control from the entry portion to the exit portion; and a pair of rotating diverter means positioned in close proximity to the entry portions of the first and second delivery path conveyor system for alternately diverting the individual sheets to the entry portion of one of the two delivery path conveyor systems without the use of a stationary diverter or guide member, each of the pair of diverter means being synchronized with the speed of the delivery path conveyor with which the diverter means is associated to engage the leading edge of a sheet at a sufficiently small angle directly divert the leading edge of the sheet under substantially continuous control into the grasp and control of the associated delivery path conveyor while the trailing edge of the sheet is still engaged in its initial receipt by said opposed rollers so as to substantially prevent damage and misalignment of the sheet, the diverter means thereafter continuing to support substantially the entire length of the sheet as the sheet is taken up by the associated delivery path conveyor and ultimately released by said opposed rollers;

the cutting means being timed so that the leading edge of the continuous web is initially received by the conveyor means before the sheet is cut from the web.

5. A sheet handling system in accordance with claim 4, wherein the diverter means comprises first and second sets of oppositely rotating diverting cams disposed on opposite sides of the travel path of the sheet material leaving the cutting means and received by the conveyor means, each set of diverting cams including a plurality of similarly shaped, spaced apart cams fixed with respect to a common axis for rotation about the axis.

6. A sheet handling system in accordance with claim 4, wherein the cutting means comprises a rotating cutter having at least one cutting blade extending across the width of the web and an opposed anvil member cooperating with the cutting blade to define a cutting area, the continuous web being passed through the cutting area to the conveyor means.

7. A sheet handling system in accordance with claim 4, wherein said opposed rollers are driven at a surface speed greater than the original speed of the web so that sheets cut from the web are spaced therefrom.

8. A sheet handling system in accordance with claim 4, wherein the delivery path conveyor systems are driven at a speed such that sheets transported in each delivery path conveyor system are spaced from each other upon arrival at the exit portion of the delivery path conveyor system.

9. A sheet handling system in accordance with claim 4, further comprising a delivery system for receiving sheets at the points of delivery of each delivery path conveyor system, decelerating the sheets, and depositing the sheets on a delivery conveyor operating at a speed less than the speed of the sheets at the point of delivery, so that the decelerated sheets will overlap in shingled relation on the delivery conveyor.

10. A sheet handling system in accordance with claim 9, wherein each delivery system comprises:

a conveyor system positioned downstream of the point of delivery, dropped relative to the travel path of the stream of sheets exiting the point of delivery and having a conveying surface facing the sheet travel path; and a snubbing means positioned near the upstream end of the conveyor system for trapping each of the incoming sheets against the conveying surface of the conveyor system so that each sheet is thereby decelerated to the speed of the conveying surface; the conveying surface being operated at a speed less than the speed of the sheets exiting the point of delivery, and the snubbing means being timed with respect to the arrival of the sheets so that a sheet is trapped against the conveying surface of the conveyor system substantially as the tail of the sheet exits the point of delivery.

11. A sheet handling system for receiving a fast moving, continuous web, cutting sheets therefrom, and diverting alternate sheets to one of two delivery paths, comprising:

a cutting means for receiving the web and cutting the web into individual sheets, thereby forming a fast moving stream of cut sheets travelling at an original speed along an original travel path;

conveyor means positioned downstream of the cutting means and defining first and second delivery paths for receiving sheets from the cutting means and transporting the sheets to predetermined points of delivery at a speed at least approximately the original speed of the web, the delivery paths being disposed on opposite sides of the original travel path of the sheet leaving the cutting means and at least initially diverging from the original travel path at approximately the same angle, each delivery path being at least partially defined by a conveyor system having an entry portion and an exit portion downstream of the entry portion, said exit portion forming the point of delivery for that delivery path, in each of which delivery paths a sheet is transported under substantially continuous control from the entry portion to the exit portion; and first and second sets of oppositely rotating diverting cams disposed on opposite sides of the travel path of the sheet material leaving the cutting means and received by the conveyor means, each set of diverting cams including a plurality of similarly shaped, spaced apart cams fixed with respect to a common axis for rotation about the axis, with at least one of the diverting cams of each set being laterally adjustable along its associated axis, each of said first and second sets of diverting cams associated with one of the two delivery path conveyor systems to alternately divert the sheet material cut by the cutting means from the original travel path to the entry portion of one of the two delivery path conveyor system under substantially continuous control and without the use of a stationary diverter or guide member, each set of diverting cams being synchronized with the speed of the associated delivery path conveyor system to engage the leading edge of a sheet at a sufficiently small angle so as to substantially prevent damage to the leading edge of the sheet and direct the leading edge of the sheet into the entry portion of the associated delivery path conveyor while the trailing edge of the sheet is still engaged in its initial receipt by the conveyor means, each set of diverting cams thereafter continuing to support substantially the entire length of the sheet as the sheet is taken up by the associated delivery path conveyor;

the cutting means being timed so that the leading edge of the continuous web is initially received by the conveyor means before the sheet is cut from the web.

12. A sheet handling system for receiving a fast moving, continuous web, cutting sheets therefrom, and diverting alternate sheets to one of two delivery paths, comprising:

a cutting means for receiving the web and cutting the web into individual sheets, thereby forming a fast moving stream of cut sheets travelling at an original speed along an original travel path;

conveyor means positioned downstream of the cutting means and defining first and second delivery paths for receiving sheets from the cutting means and transporting the sheets to predetermined points of delivery at a speed at least approximately the original speed of the sheets, the delivery paths being disposed on opposite sides of the original travel path of the sheet leaving the cutting means and at least initially diverging from the original travel path at approximately the same angle, each delivery path being at least partially defined by a conveyor system having an entry portion and an exit portion downstream of the entry portion, said exit portion forming the point of delivery for that delivery path, in each of which delivery paths a sheet is transported under substantially continuous control from the entry portion to the exit portion;

a pair of rotating diverter means for alternately diverting the sheet material cut by the cutting means from the original travel path to the entry portion of one of the two delivery path conveyor systems under substantially continuous control and without the use of a stationary diverter or guide member, each of the pair of diverter means being synchronized with the speed of the delivery path conveyor with which the diverter means is associated to engage the leading edge of a sheet at a sufficiently small angle so as to substantially prevent damage to the leading edge of the sheet and direct the leading edge of the sheet into the entry portion of the associated delivery path conveyor while the trailing edge of the sheet is still engaged in its initial receipt by the conveyor means, the diverter means thereafter continuing to support substantially the entire length of the sheet as the sheet is taken up by the associated delivery path conveyor;

said pair of diverter means being driven by a source of mechanical power through a clutch means for disengaging said pair of diverter means from the power source upon the application of a predetermined resistance to the rotation of either of the pair of diverter means during operation;

the cutting means being timed so that the leading edge of the continuous web is initially received by the conveyor means before the sheet is cut from the web.

13. A sheet diverter and delivery system adjustable to separately receive various widths of fast moving, continuous webs, cutting sheets therefrom, and diverting alternate sheets to one of two delivery paths for subsequent processing, all while maintaining substantially continuous control of the individual sheets, comprising:

first conveyor means including cutting means for cutting a fast moving continuous web into a stream of separate sheets and directing the sheets along an original travel path at an original speed;

second conveyor means and third conveyor means each having an entrance end and an exit end and each including at least a pair of laterally adjustable closely spaced face to face belts, said entrance ends being positioned downstream of said cutting means of said first conveyor means and said second conveyor means disposed above said third conveyor means, the second and third conveyor means being driven at a speed at least approximately the original speed of the sheets and being positioned on alternate sides of the original travel path and diverging from the original travel path at approximately the same angle;

a pair of laterally adjustable rotating diverting means for alternately diverting the separate sheets from the original travel path into the second and third conveyor means without the use of a stationary diverter or guide member, each of the diverter means being synchronized with the speed of the one of the second and third conveyor means with which the diverter means is associated to engage the leading edge of the sheet to be diverted at a sufficiently small angle so as to avoid damage to the leading edge of the sheet and direct the leading edge of the sheet into the entrance end of the associated conveyor means before the trailing edge of the sheet is disengaged from the first conveyor means, the diverter means thereafter continuing to support substantially the entire length of the sheet as the sheet is taken up by the associated conveyor means; and means connected with each of said second and third conveyor means for decelerating and shingling said sheets for delivering two separate streams of shingled sheets to a subsequent processing station.

* * * * *